US005649412A

United States Patent [19]

Binacchi

[11] Patent Number: 5,649,412

[45] Date of Patent: Jul. 22, 1997

[54] APPARATUS FOR MAKING, STARTING FROM A CONTINUOUS FILM, COFFEE ROUND OR NOT ROUND COFFEE WAFERS, FOR ESPRESSO-COFFEE MAKING MACHINES

[76] Inventor: Fabio Binacchi, Via G. Mercalli, 16/A, 43100 Parma, Italy

[21] Appl. No.: 666,877

[22] Filed: May 25, 1996

[30] Foreign Application Priority Data

Dec. 19, 1995 [IT] Italy ..... MI95A2675

[51] Int. Cl.[6] ..... A47J 31/00; B65B 47/04; B65B 47/10

[52] U.S. Cl. ..... 53/559; 53/453; 99/295; 99/306; 426/77

[58] Field of Search ..... 99/450.4, 450.1, 99/295, 306, 275; 53/453, 559, 579, 141; 425/373, 388; 206/0.5; 426/77, 394

[56] References Cited

U.S. PATENT DOCUMENTS

| | | | |
|---|---|---|---|
| 3,346,388 | 10/1967 | Andrews et al. | 206/0.5 |
| 3,823,656 | 7/1974 | Vander Veken | 99/306 X |
| 4,018,030 | 4/1977 | Christensson | 99/472 |
| 4,828,850 | 5/1989 | Davis | 99/323 |
| 5,012,629 | 5/1991 | Rehman et al. | 53/453 |
| 5,081,819 | 1/1992 | Cloud | 53/453 |

*Primary Examiner*—Timothy F. Simone
*Attorney, Agent, or Firm*—Bucknam and Archer

[57] ABSTRACT

The apparatus comprises means for driving plates along an advancing path, each of which is provided, on a top face thereof, with a plurality of recesses. Along the advancing path is arranged a first delivery station for delivering a first permeable film strip, having a width adapted to substantially cover all of the recesses of each plate and cutting means for cutting into strips said film in a longitudinal direction thereof, as well as means for cross-cutting the cut strips. Moreover, in the first station, a coffee dose is delivered at each recess, on the top of the film previously deposited on the plates. Downstream of the first station is provided a second pressing station for pressing the coffee doses supplied on the plates and a third delivery station for delivery a second permeable film web on the top of the pressed coffee doses. In the third station are provided cutting means for cutting the second film web into longitudinal strips as well as means for cutting in a cross direction the cut strips. In the third station are moreover provided sealing means for sealing to one another the two films, in order to fit therebetween the pressed coffee doses. In a fourth station, the sealed films are cut about the embedded coffee doses, for finishing the thus formed wafer elements.

6 Claims, 3 Drawing Sheets

APPARATUS FOR MAKING, STARTING FROM A CONTINUOUS FILM, COFFEE ROUND OR NOT ROUND COFFEE WAFERS, FOR ESPRESSO-COFFEE MAKING MACHINES

BACKGROUND OF THE INVENTION

The present invention relates to an apparatus for making, from a continuous film material, coffee wafer elements, either of round or not round shape, for automatic espresso-coffee machines.

Apparatus for making, from a continuous film, round coffee wafers, for automatic espresso coffee making machines are already known.

These apparatus are mainly constituted by a chain supporting a plurality of plates which are evenly spaced from one another along said chain and are each provided, on a top face thereof, with a recess.

Along the path followed by the chain, is generally arranged a first station, in which a permeable film length is deposited on the top of each plate, so as to cover a related recess.

In the first station is provided a metering device which delivers, on the top of the permeable film length, at the recess respectively arranged in the first station, a set ground coffee dose.

Along the path followed by the chain are provided further processing stations, i.e.: a pressing station for pressing the delivered coffee dose, a covering station in which the supplied coffee dose is covered by a second length or portion of permeable film and in which the two film lengths are sealed to one another so as to embed therein the coffee dose, as well as an end station, in which the thus sealed film lengths are cut about the embedded coffee dose so as to provide round coffee wafers or discs.

The above mentioned apparatus for making coffee wafers, however, are affected by several drawbacks.

In fact, since each plate, coupled to the chain for driving the plate through the processing stations, is provided with a single dose receiving recess, it is necessary to use permeable film rolls of a comparatively small width, which are quickly exhausted so as to require frequent replacing operations, with a consequent very low yield of the overall machine or apparatus.

This will consequently increase the cost of the produced coffee wafer or disc elements.

Moreover, the above mentioned prior apparatus have a comparatively large size, with a consequent problem of properly arranging the apparatus in a production shop.

SUMMARY OF THE INVENTION

Accordingly, the aim of the present invention is to overcome the above mentioned problems, by providing a coffee wafer making apparatus which, the operating speed thereof being the same, will allow to obtain an increased production yield, with respect to prior like apparatus.

Within the scope of the above mentioned aim, a main object of the present invention is to provide such an apparatus which, the product yield being the same, will require a number of permeable film replacing operations much less than that of prior apparatus.

Another object of the present invention is to provide such a coffee wafer making apparatus which has a size much smaller than that of prior apparatus.

Yet another object of the present invention is to provide such a coffee wafer making apparatus in which the metering of the supplied coffee can be precisely controlled and adjusted.

According to one aspect of the present invention, the above mentioned aim and objects, as well as yet other objects, which will become more apparent hereinafter, are achieved by an apparatus for making, from a continuous film, coffee wafers, either of round shape or not, for automatic espresso coffee machines, characterized in that said apparatus comprises driving means for driving a plurality of plates along an advancing path therefor.

Each of the mentioned plates is provided, on a top surface thereof, with a plurality of coffee dose receiving recesses, which are arranged transversely of the plate advancing direction.

Along the plate advancing direction is provided a first delivery station for delivering a first permeable film web, said web having a width adapted to substantially cover all of the recesses of each plate; at said first station being provided cutting means for cutting said film into strips in a longitudinal direction thereof as well as further cutting means for cutting said film strips in the cross direction thereof; in said first station being moreover provided coffee dose delivering means for delivering or supplying a coffee dose into each of said recesses on the top of said film deposited on said plate.

Downstream of the first station are moreover provided: a second pressing station for pressing the coffee doses delivered on said plates, a third delivery station for delivering a second permeable film web on the top of said pressed coffee doses.

Said third station is provided with cutting means for cutting the second film web into longitudinal strips as well as with further cutting means for transversely cutting said film strips in a cross direction, as well as with sealing means for sealing the two films to one another to embed therein the pressed coffee doses, as well as a fourth station for cutting the sealed films about said coffee doses embedded between said films, in order to provide finished coffee wafers.

BRIEF DESCRIPTION OF THE DRAWINGS

Further characteristics and advantages of the apparatus according to the present invention will become more apparent hereinafter from the following detailed disclosure of two preferred, though not exclusive, embodiments of said apparatus which are illustrated, by way of an indicative, but not limitative, example, in the figures of the accompanying drawings, where.

DESCRIPTION OF THE PREFERRED EMBODIMENTS

Figure 1:
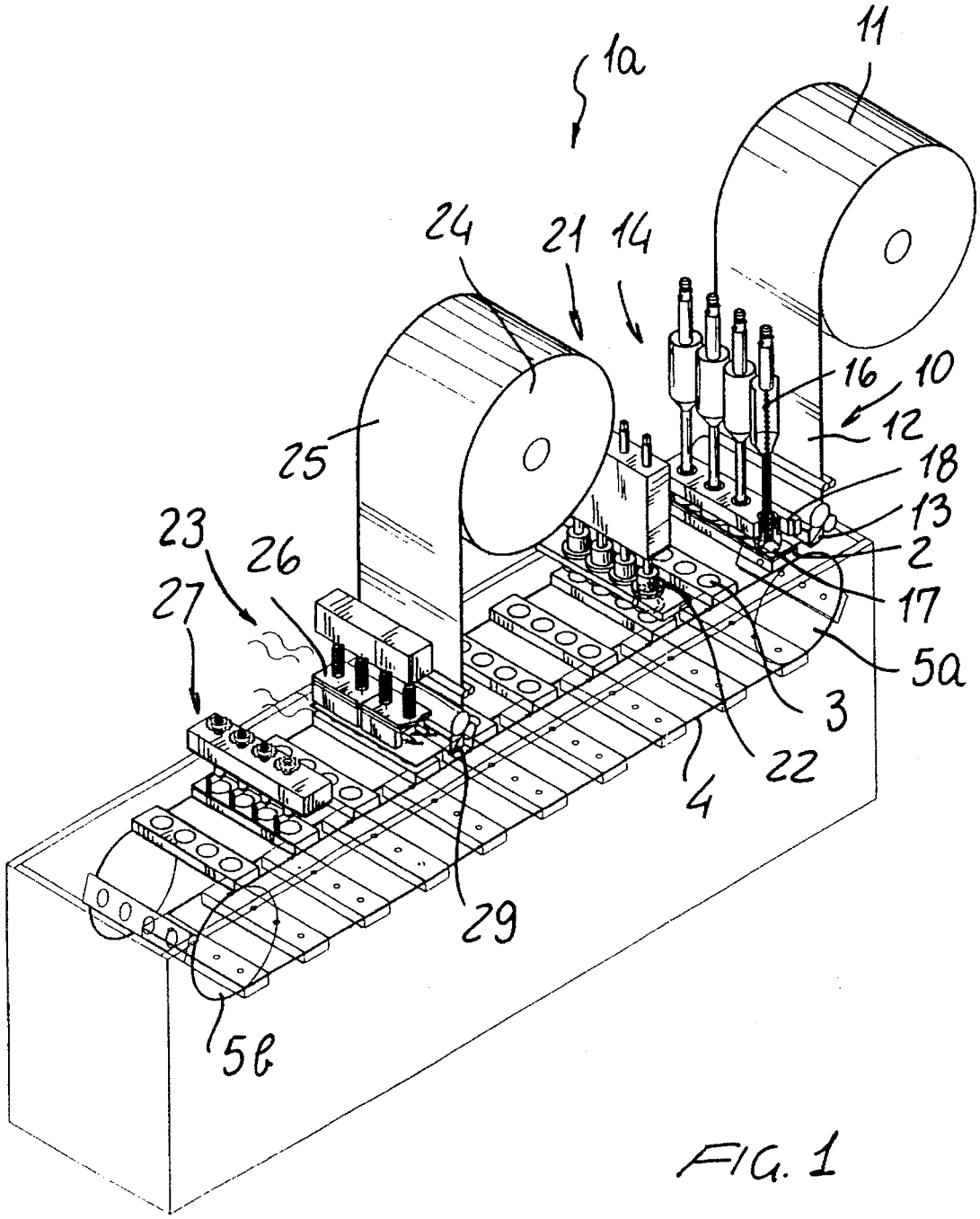
FIG. 1 is a perspective view illustrating a first embodiment of the apparatus according to the present invention.

With reference to the number references of the above mentioned drawing figures, the coffee wafer making apparatus, according to the present invention, which has been generally indicated, in the two embodiments thereof, by the reference number 1*a* and 1*b*, comprises driving means for driving a plurality of plates 2 along a plate advancement path which, in the first embodiment, is rectilinear and, in the second embodiment of the apparatus, is a circular path.

The plates 2 of the two embodiments are provided, on the top surface thereof, with a plurality of coffee dose receiving recesses 3 which adjoin one another in a cross direction of the plates 2, i.e. a direction transverse to the plate 2 advancing direction.

In the first embodiment, the driving means for driving said plates 2 substantially comprise a chain 4 entrained on a pair of rollers or pinions 5*a* and 5*b* having horizontal parallel axes.

At least one of said rollers or pinions 5*a* and 5*b* is driven, by an intermittent rotary movement, about the related axis, so as to cause said plates 2 to progressively intermittently advance in order to arrange successively said plates in the several processing stations of the apparatus.

As shown, the plates 2 are coupled to the chain 4 and are evenly spaced from one another.

In the second embodiment, the driving means comprise a table 6 which can be controllably turned about a vertical axis 7. The plates 2 are made as spokes of said table 6, and are radially arranged about the axis 7 and angularly evenly spaced from one another about said axis 7.

The table 6 can be rotatively driven, in an intermitted manner, about said axis 7 so as to cause said plates 2 to be arranged in the several apparatus processing stations, said stations being distributed along the circular path followed by the plates 2 as the table 6 is turned.

More specifically, the processing or operating stations of the subject apparatus comprise a first station 10, in which is supported a roll 11 of a first permeable film web 12, the width of which is so designed as to substantially cover all of the coffee dose receiving recesses 3 of each plate 2.

In the first station 10 are moreover provided cutting means for cutting said film 12 into film strips in a longitudinal direction of said film. The width of each film strip is adapted to fully cover a coffee dose receiving recess 3. The cutting means for cutting said film into film strips, longitudinally of said film, comprise any types of known cutting means which, for simplicity, have not been specifically shown.

In the first station 10 is moreover provided a blade 13 operating for cutting said film strips in a cross direction, after having deposited said film strips on the top surface of the plate 2 arranged in said first station 10.

The first station 10 comprises moreover delivery means 14 for delivering a coffee dose 15 into each of said recesses 3, on the top of the film 12.

As shown in FIG. 1, the coffee dose delivering means 14 can comprise either one or more screw dosing devices 16 provided for depositing a set coffee dose directly on the film 12 and which, by means of a pad 17 rotating about the axis of the screw, will distribute and pre-press the coffee.

Then, on the pre-pressed coffee dose a covering element 18 is engaged and then a pad, arranged inside said covering element, and suitably contoured and turned, will further press to an end condition said coffee dose.

Figure 2:
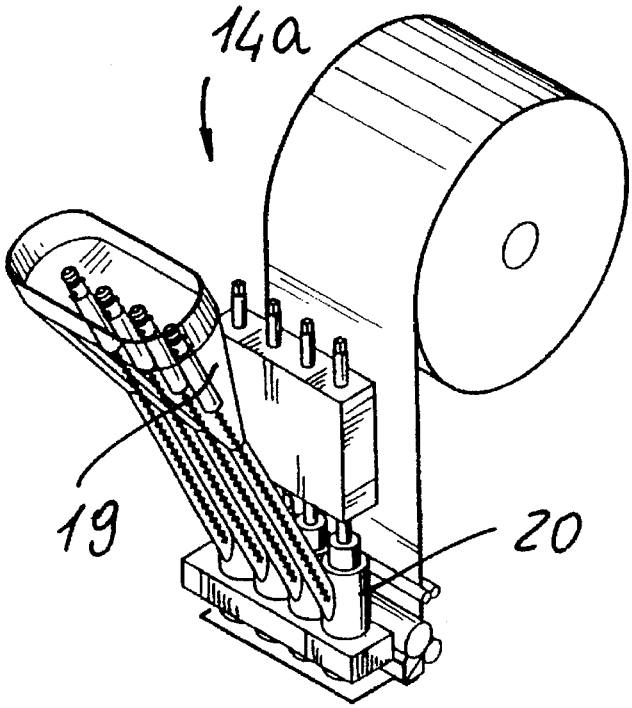
FIG. 2 is a further perspective view illustrating a variation of the coffee dose delivering means provided in the first processing station of the subject apparatus.
Figure 3:
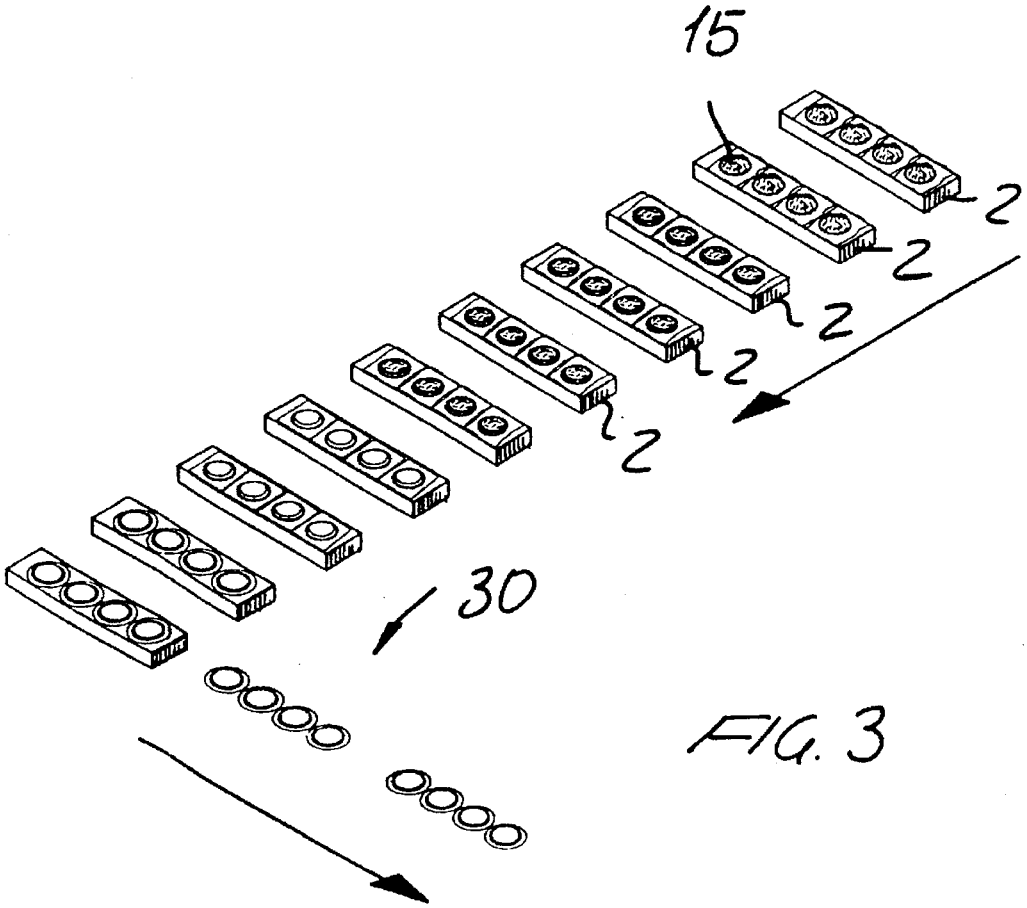
FIG. 3 is a schematic view illustrating the several operating steps of the subject apparatus.
Figure 5:
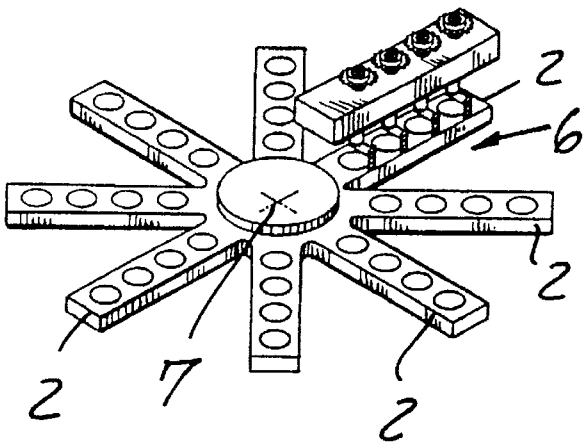
FIG. 5 illustrates a detail of the apparatus shown in FIG. 4.
Figure 4:
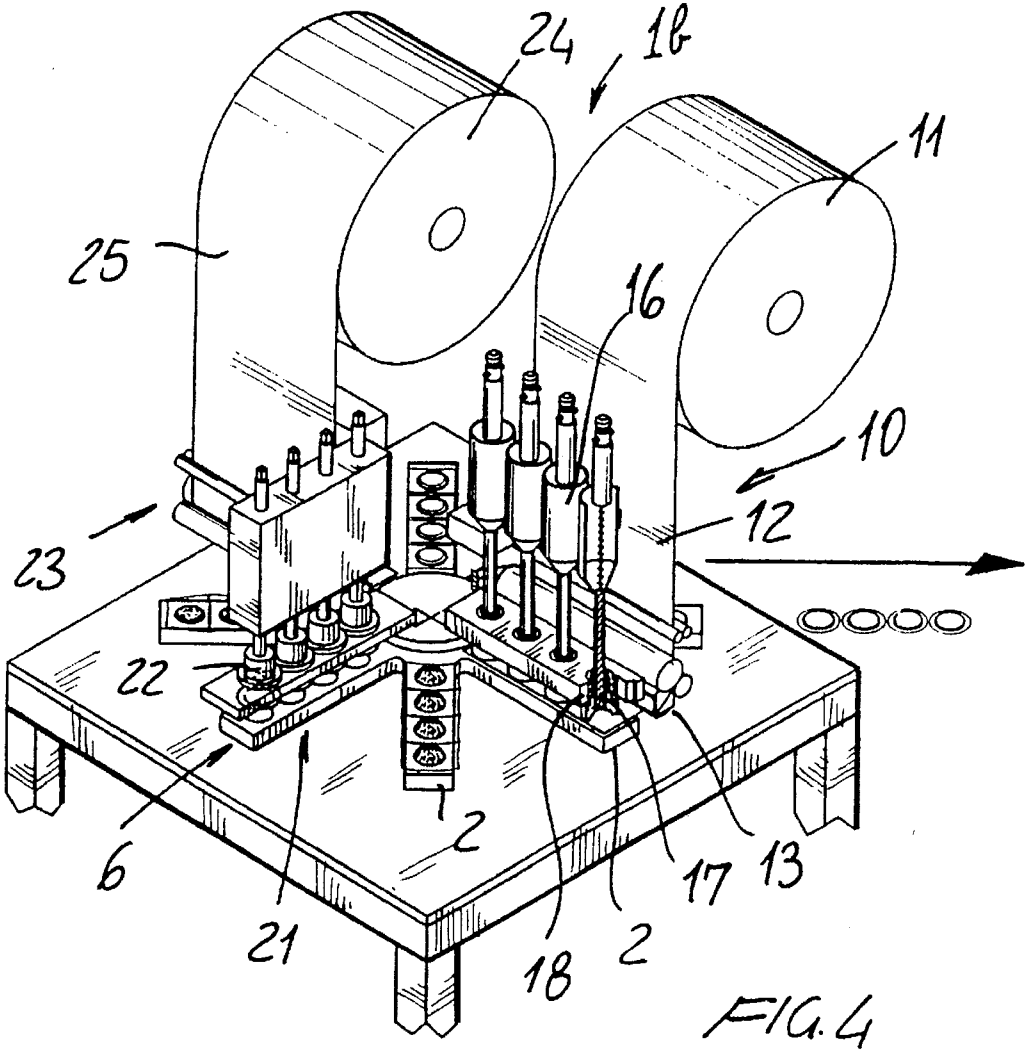
FIG. 4 is a further perspective view illustrating a second embodiment of the subject apparatus.

As is clearly shown in FIG. 2, the coffee dose delivering means, which is herein indicated by the reference number 14*a*, can also be formed by one or more screw metering devices 19, provided for depositing a set coffee amount into one or more cylindrical vessels 20 (barrels), brought into contact with the film 12.

Then, a pad, arranged near the respective barrel, and of suitable shape and suitably turned about a vertical axis, will be lowered to press the coffee.

The coffee dose delivering means can also be constituted by weighing means, of any known types which, for simplicity, have not been specifically illustrated.

Downstream of the first station 10 is arranged a second station 21, in which, by means of vertically movable pads 22 the coffee doses deposited on the film 12 at the recesses 3, are suitably pressed.

After the second station 21, or downstream therefrom, is arranged a third station 23, in which is supported a second roll 24 for supporting a second permeable film 25, which will be deposited on the pressed coffee doses.

In the third station 23 are moreover provided, as in the first station 10, cutting means for cutting the second film 25 into longitudinal strips as well as a cutting blade 29 provided for cross cutting the longitudinally cut film strips.

The third station 23 comprises moreover sealing means 26, of any known types, for sealing the two films 12 and 25 so as to embed therein the pressed coffee doses.

Downstream of the third station 23 is provided a fourth station 27 in which are arranged cutting means for cutting the films 12 and 25 at the region thereof sealed about the coffee doses, and so that as to provide finished coffee wafers.

At the output of the apparatus is provided a weighing device 30 for weighing the coffee wafers, said weighing device 30 being coupled to the coffee dose delivering means of the first station 10 so as to adjust in a feed-back like manner, the supplied coffee dose.

Thus, since the apparatus according to the present invention can use permeable film rolls having a width which is much greater than that of the film rolls used in prior apparatus, it will be possible to obtain a very increased yield, the driving speed of the several station elements being the same, than that of the prior apparatus or, the yield being the same, it will be possible to greatly reduce the film roller replacement operations.

Since each plate is provided with a plurality of adjoining coffee dose receiving recesses, in addition to using greater width film rolls, it will be also possible to provide an apparatus which, the yield being the same, will have a very reduced size, thereby said apparatus can be easily fitted in small space production shops.

From the above disclosure and from an observation of the several figures of the accompanying drawings, it should be apparent that the subject apparatus fully achieves the intended aim and objects.

Moreover, owing to the feedback control and adjustment of the supplied coffee doses, the coffee can be metered in a highly precise manner.

While the apparatus has been disclosed with reference to preferred embodiments thereof, it should be apparent that the disclosed embodiments are susceptible to many modifications and variations all of which will come within the scope and spirit of the appended claims.

What is claimed is:

1. An apparatus for making round or not round coffee wafers from a continuous film for automatic espresso making machines, said apparatus comprising:

a) a plurality of plates driven by driving means along an advancing path, each of said plates having a plurality of coffee dose receiving recesses on a top surface thereof arranged transverse to the advancing path;

b) a first permeable film web delivered to said plates at a first station along the advancing path of said plates, said film web having a width to substantially cover all of the recesses of each plate;

c) first cutting means arranged at said first station for cutting said film web into strips along a longitudinal direction thereof;

d) second cutting means arranged at said first station for cutting said film strips in a cross direction thereof;

e) delivering means arranged at said first station for delivering a coffee dose into each recess of said plates on top of the film deposited on said plates;

f) pressing means arranged at a second station along the advancing path of said plates for pressing the coffee doses in the recesses on said plates;

g) a second permeable film web delivered on top of said pressed coffee doses on said plates at a third station along the advancing path of said plates;

h) first cutting means arranged at said third station for cutting said second film web into longitudinal strips;

i) second cutting means arranged at said third station for cutting the longitudinal strips of said second film transversely;

j) sealing means arranged at said third station for sealing together said first and second film webs so as to embed the pressed coffee doses therein; and k) cutting means arranged at a fourth station along the advancing path of said plates for cutting the first and second film webs in the region thereof sealed about the coffee doses to provide finished coffee wafers.

2. The apparatus as defined in claim 1, which further comprises a weighing device for weighing said coffee wafers arranged at an outlet of said advancing path, said weighing device being coupled to said coffee dose delivery means so as to feed back adjust the delivered coffee amount.

3. The apparatus as defined in claim 1, wherein said advancing path is a substantially rectilinear path and said driving means comprise a linear chain supporting a plurality of said plates evenly spaced from one another.

4. The apparatus as defined in claim 1, wherein said advancing path is a substantially circular path and said driving means comprises a rotary table rotating about a vertical axis with an intermittent motion, said plates being arranged radially about said axis and evenly angularly spaced from one another about said axis.

5. The apparatus as defined in claim 1, wherein said coffee dose delivering means includes screw metering devices each of which is provided with a pressing element for pressing the delivered coffee doses.

6. The apparatus as defined in claim 1, wherein said coffee dose delivering means includes a weighing device for weighing the delivered coffee amount.

* * * * *